US007805099B2

(12) United States Patent
Wayman et al.

(10) Patent No.: US 7,805,099 B2
(45) Date of Patent: Sep. 28, 2010

(54) TEETER-TOTTER VALVE FOR CARRIER REPLENISHMENT SYSTEM

(75) Inventors: William H Wayman, Ontario, NY (US); David B Playfair, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 494 days.

(21) Appl. No.: 11/960,295

(22) Filed: Dec. 19, 2007

(65) Prior Publication Data

US 2009/0162105 A1 Jun. 25, 2009

(51) Int. Cl.
*G03G 15/08* (2006.01)

(52) U.S. Cl. ..... 399/260; 137/909; 251/65

(58) Field of Classification Search ..... 34/249; 137/909; 141/2, 18; 251/65; 399/53, 252–254, 399/258–260

See application file for complete search history.

(56) References Cited

U.S. PATENT DOCUMENTS 3,717,122 A * 2/1973 Hudson ..... 118/636
4,463,502 A * 8/1984 Fitzgerald et al. ..... 34/249
5,095,338 A 3/1992 Hayes, Jr. et al.
5,685,348 A * 11/1997 Wegman et al. ..... 141/2

OTHER PUBLICATIONS

William H. Wayman, U.S. Appl. No. 11/960,258, entitled "Carrier Replenishment and Image Mottle Reduction System", filed simultaneously herewith.
William H. Wayman, U.S. Appl. No. 11/960,330, entitled "A Toner Image Reproduction Machine Including a Ball Valve Device Having a Pressure Release Assembly", filed simultaneously herewith.

* cited by examiner

*Primary Examiner*—David P Porta
*Assistant Examiner*—Benjamin Schmitt
(74) *Attorney, Agent, or Firm*—Oliff & Berridge, PLC

(57) ABSTRACT

A teeter-totter valve device for metering magnetic particles from a hopper includes (i) a tube connected to the hopper for flow of magnetic particles out of the hopper; (ii) a teeter-totter member having a first arm including a first distal end, and a second adjustable arm including a second distal end; (iii) a support assembly supporting the teeter-totter member on and spaced from the tube; (iv) a first magnet located at the first distal end; (v) a second magnet located at the second distal; and (vi) a moving assembly for moving each of the first magnet and the second magnet towards and away from a first near point and a second near point on the tube to create or remove a point magnetic field and magnetic particles dam within the tube, thereby stopping or allowing flow of a desired quantity of magnetic particles past the first near point and past the second near point.

20 Claims, 4 Drawing Sheets

TEETER-TOTTER VALVE FOR CARRIER REPLENISHMENT SYSTEM

RELATED APPLICATIONS

This application is related to U.S. application Ser. No. 11/960,258 entitled "CARRIER REPLENISHMENT AND IMAGE MOTTLE REDUCTION SYSTEM" and U.S. application Ser. No 11/960,330 entitled "A TONER IMAGE REPRODUCTION MACHINE INCLUDING A BALL VALVE DEVICE HAVING A PRESSURE RELEASE ASSEMBLY" both filed on the same date herewith, and having at least one common inventor.

BACKGROUND OF THE DISCLOSURE

The present disclosure relates generally to toner image reproduction machines, and more particularly, concerns such a machine having a carrier replenishment system including a teeter-totter valve for a carrier replenishment system.

In a typical toner image reproduction machine, for example an electrostatographic printing process machine contained within a single enclosing frame, an imaging region of a toner image bearing member such as a photoconductive member is charged to a substantially uniform potential so as to sensitize the surface thereof. The charged portion of the photoconductive member is irradiated or exposed to a light image of an original document being reproduced. Exposure of the charged photoconductive member selectively dissipates the charges thereon in the irradiated areas. This records an electrostatic latent image on the photoconductive member corresponding to the informational areas contained within the original document.

After the electrostatic latent image is recorded on the photoconductive member, the latent image is developed at a development station by bringing a developer material in a developer housing into contact therewith. Generally, the developer material comprises magnetic carrier particles and toner particles that adhere triboelectrically to carrier particles. During development, the toner particles are attracted from the carrier particles to the latent image thereby forming a toner powder image on the photoconductive member. The toner powder image is then transferred from the photoconductive member to a copy sheet. The toner particles are then heated by a fusing apparatus within the single enclosed frame to permanently affix the powder image to the copy sheet.

Toner particles in the developer material in the developer housing accordingly become more and more depleted during image development as described above, ordinarily resulting in diminishing image quality. To maintain image quality, fresh toner particles therefore must be regularly added to the development. It has also been found that image quality can further be improved by regularly also adding fresh carrier particles to the developer housing, for example, using a carrier replenishment system.

SUMMARY OF THE DISCLOSURE

In accordance with the present disclosure, there has been provided a teeter-totter valve device for metering magnetic particles from a hopper that includes (i) a tube connected to the hopper for flow of magnetic particles out of the hopper; (ii) a teeter-totter member having a first arm including a first distal end, and a second adjustable arm including a second distal end; (iii) a support assembly supporting the teeter-totter member on and spaced from the tube; (iv) a first magnet located at the first distal end; (v) a second magnet located at the second distal; and (vi) a moving assembly for moving each of the first magnet and the second magnet towards and away from a first near point and a second near point on the tube to create or remove a point magnetic field and magnetic particles dam within the tube, thereby stopping or allowing flow of a desired quantity of magnetic particles past the first near point and past the second near point.

BRIEF DESCRIPTION OF DRAWINGS

The foregoing and other features of the instant disclosure will be apparent and easily understood from a further reading of the specification, claims and by reference to the accompanying drawing in that:

DETAILED DESCRIPTION

Figure 1:
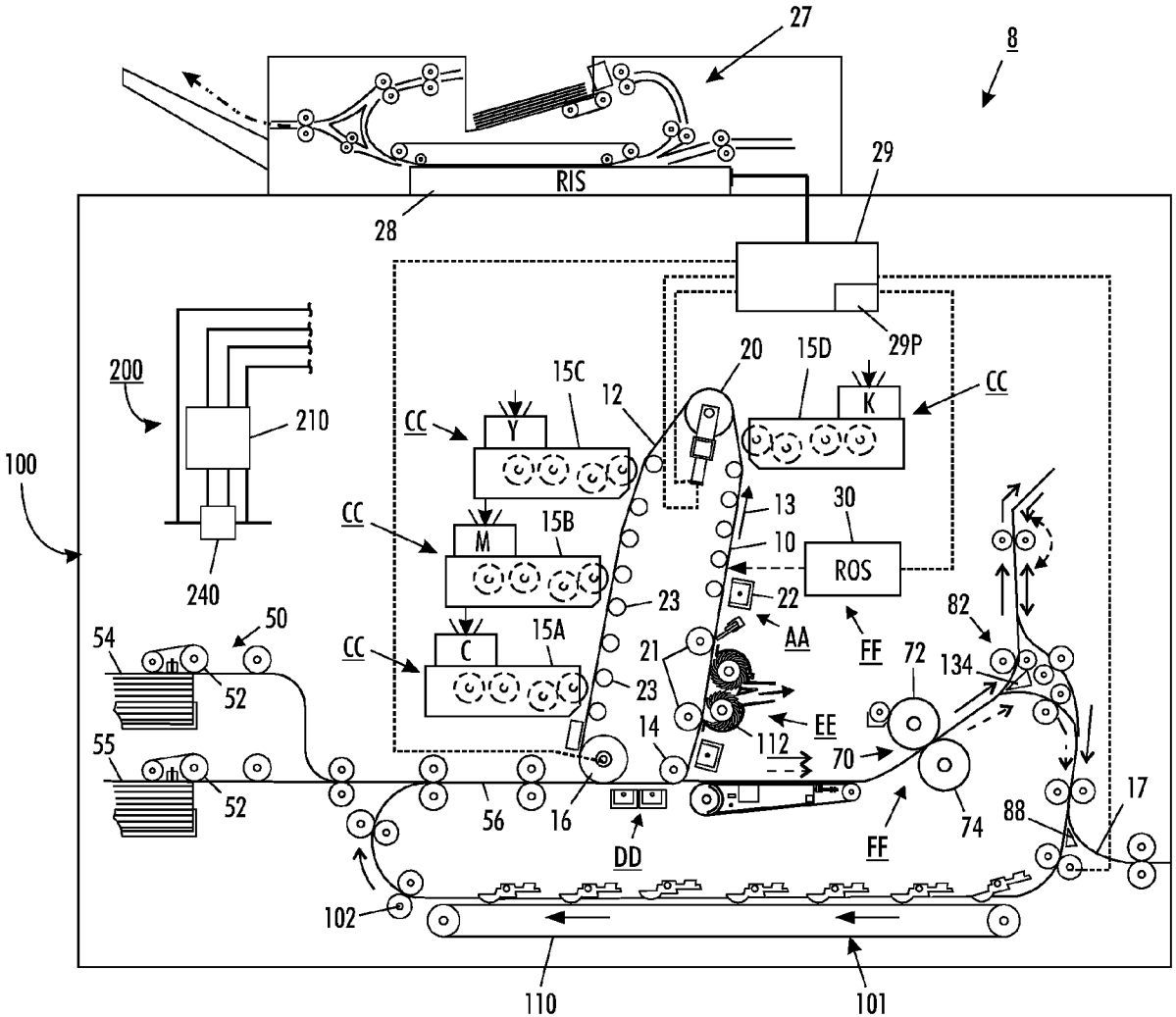
FIG. 1 is a schematic elevational view of the electrostatographic reproduction machine of the present disclosure including a carrier replenishment system having a teeter-totter valve in accordance with the present disclosure.

Referring first to the FIG. 1, it schematically illustrates an electrostatographic reproduction machine 8 that employs a photoconductive belt 10 mounted on a belt support module within a machine frame 11. Preferably, the photoconductive belt 10 is made from a photoconductive material coated on a conductive grounding layer that, in turn, is coated on an anti-curl backing layer. Belt 10 moves in the direction of arrow 13 to advance successive portions sequentially through various processing stations disposed about the path of movement thereof. Belt 10 is entrained as a closed loop about stripping roll 14, drive roll 16, idler roll 21, and backer rolls 23.

Initially, a portion of the photoconductive belt surface passes through charging station AA. At charging station AA, a charging wire of a corona-generating device indicated generally by the reference numeral 22 charges the photoconductive belt 10 to a relatively high, substantially uniform potential.

As also shown the reproduction machine 8 includes a controller or electronic control subsystem (ESS) 29 that is preferably a self-contained, dedicated minicomputer having a central processor unit (CPU), electronic storage, and a display or user interface (UI). The ESS 29, with the help of sensors and connections, can read, capture, prepare and process image data and machine component status information to be used for controlling operation of each such machine component.

Still referring to the FIG. 1, at an exposure station BB, the controller or electronic subsystem (ESS), 29, receives image signals from a raster input scanner (RIS) 28, representing a desired output image, and processes these signals to convert them to a continuous tone or gray scale rendition of the image that is transmitted to a modulated output generator, for example the raster output scanner (ROS), indicated generally by reference numeral 30. The image signals transmitted to ESS 29 may originate from RIS 28 as described above or from a computer, thereby enabling the electrostatographic reproduction machine 8 to serve equally as a remotely located printer for one or more computers. Alternatively, the printer may serve as a dedicated printer for a high-speed computer. The signals from ESS 29, corresponding to the continuous tone image desired to be reproduced by the reproduction machine, are transmitted to ROS 30.

ROS 30 includes a laser with rotating polygon mirror blocks. Preferably a nine-facet polygon is used. At exposure station BB, the ROS 30 illuminates the charged portion on the surface of photoconductive belt 10 at a resolution of about 300 or more pixels per inch. The ROS will expose the photoconductive belt 10 to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image through development stations CC, that include four developer housings 15A, 15B, 15C, 15D as shown, containing developer material, for example two-component developer material consisting of charged magnetic carrier particles and triboelectrically charged CMYK color toner particles, one color per developer housing. At each developer housing 15A, 15B, 15C, 15D the charged toner particles contained in the developer material that is in-use are appropriately attracted electrostatically to, and develop the latent image.

As pointed out above, in-use developer material (that is, the mix of carrier and toner particles) in each developer housing typically becomes depleted of toner particles over time as toner particles are attracted to, and develop more and more images. This is one cause of poor image quality. Fresh toner particles hence have to be frequently and controllably added to the developer housing. Another cause of poor image quality has been found to be aging carrier—a problem addressed by the carrier replenishment apparatus and teeter-totter valve of the present disclosure (described in detail below).

With continued reference to FIG. 1, after the electrostatic latent image is developed, the toner powder image present on belt 10 advances to transfer station DD. A print sheet 48 is advanced to the transfer station DD, by a sheet feeding apparatus 50. Sheet-feeding apparatus 50 may include a corrugated vacuum feeder (TCVF) assembly 52 for contacting the uppermost sheet of stack 54, 55. TCVF 52 acquires each top copy sheet 48 and advances it to sheet transport 56. Sheet transport 56 directs the advancing sheet 48 into image transfer station DD to receive a toner image from photoreceptor belt 10 in a timed manner. Transfer station DD typically includes a corona-generating device 58 that sprays ions onto the backside of copy sheet 48. This assists in attracting the toner powder image from photoconductive surface 12 to sheet 48. After transfer, sheet 48 continues to move in the direction of arrow 60 where it is picked up by a pre-fuser transport assembly 101 and forwarded by means of a vacuum transport 110 to a fusing station FF that includes a fuser assembly 70.

The fuser assembly 70 for example, includes a heated fuser roller 72 and a pressure roller 74 with the powder image on the copy sheet contacting fuser roller 72. The pressure roller is crammed against the fuser roller to provide the necessary pressure to fix the toner powder image to the copy sheet. The fuser roller 72 is internally heated by a quartz lamp (not shown).

The sheet 48 then passes through fuser assembly 70 where the image is permanently fixed or fused to the sheet. After passing through fuser 70, a gate 88 either allows the sheet to move directly via output 17 to a finisher or stacker, or deflects the sheet into the duplex path 101. Specifically, the sheet (when being directed into the duplex path 101), is first passed through a gate 134 into a single sheet inverter 82. That is, if the second sheet is either a simplex sheet, or a completed duplexed sheet having both side one and side two images formed thereon, the sheet will be conveyed via gate 88 directly to output 17. However, if the sheet is being duplexed and is then only printed with a side one image, the gate 88 will be positioned to deflect that sheet into the inverter 82 and into the duplex loop path 101, where that sheet will be inverted and then fed to acceleration nip 102 and belt transports 110, for recirculation back through transfer station DD and fuser 70 for receiving and permanently fixing the side two image to the backside of that duplex sheet, before it exits via exit path 17.

After the print sheet is separated from photoconductive surface 12 of belt 10, the residual toner/developer and paper fiber particles still on and may be adhering to photoconductive surface 12 are then removed therefrom by a cleaning apparatus 112 at cleaning station EE.

Still referring to FIG. 1, after passing through the fusing apparatus 70, a gate 88 either allows the sheet to move directly via output 17 to a finisher or stacker (not shown), or deflects the sheet into the duplex path 101. Specifically, the sheet (when being directed into the duplex path 101), is first passed through a gate 134 into a single sheet inverter 82. That is, if the second sheet is either a simplex sheet, or a completed duplexed sheet having both side one and side two images formed thereon, the sheet will be conveyed via gate 88 directly to output 17. However, if the sheet is being duplexed and is then only printed with a side one image, the gate 88 will be positioned to deflect that sheet into the inverter 82 and into the duplex loop path 101, where that sheet will be inverted and then fed for recirculation back through the toner image forming module for receiving an unfused toner image on side two thereof.

Figure 2:
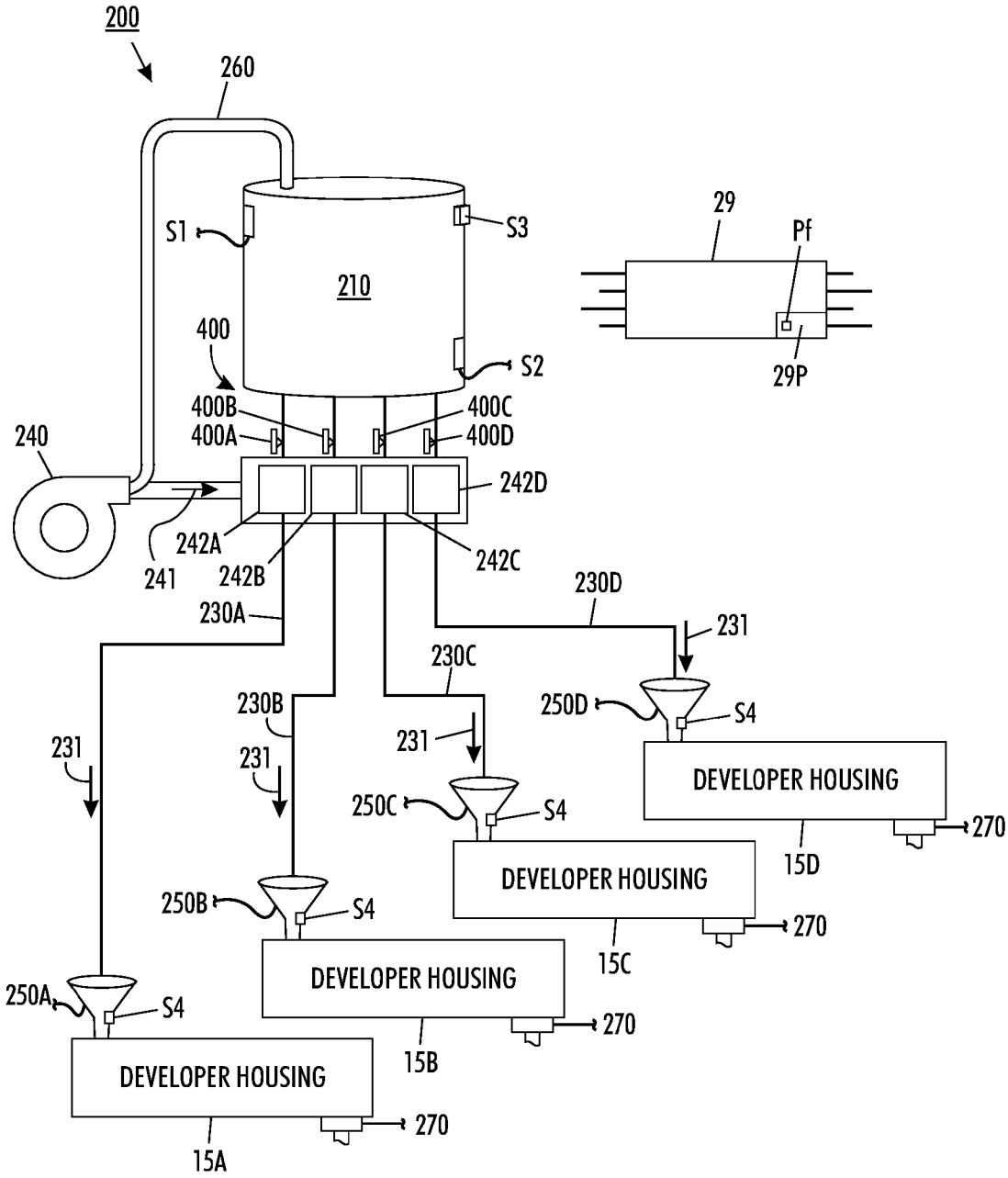
FIG. 2 is an enlarged schematic of the carrier replenishment system including the teeter-totter valve of the present disclosure.

Referring now to FIGS. 1-2, the carrier replenishment system 200 of the present disclosure is illustrated in which desired quantities of fresh magnetic carrier particles are metered from the carrier-only hopper 210 through the metering valves 400 (and more specifically 400A, 400B, 400C, 400D) through pneumatic plenums 242A, 242B, 242C, 242D into small diameter transport tubes 230A, 230B, 230C, 230D as shown. An air blower 240 is connected to the system to supply pressurized air 241 to the transport tubes and to pressurize the storage hopper through tube 260. The air 241 after picking up carrier particles becomes a particle laden airflow or air stream 231 in the small diameter tubes that transports the metered carrier from the storage hopper through separator assemblies 250*a*, 250B, 250C, 250D to the individual developer housings 15A, 15B, 15C, 15D. Each developer housing as shown includes a "trickle" port 270 for allowing overflow of in-use developer material. In this way the developer housing sump level remains constant even though fresh carrier is being added.

As further shown, in accordance with the system 200, the carrier-only hopper 210 includes level sensors S1 and S2, as well a pressure sensor S3 being monitored by controller 29 and a system program 29P. The hopper 210 as such needs to be maintained at the same air pressure as the valves and transport tubes in order to eliminate any pressure drop across the metering valves. This is because the metering valves work by gravity and so are sensitive to any differential air pressure across them. Additionally, the hopper cannot be vented at any time to atmospheric pressure because that will create a pressure difference across the metering valves and thus block the gravitational flow of carrier through the valves.

Referring now to FIGS. 1-4, a teeter-totter valve or valve assembly 400 using magnets is disclosed, whereby magnetic fields are used to control and meter the gravitational flow of magnetic material in general, for example magnetic carrier particles in vertically oriented non-magnetic pipes or tubes. The use of one or more permanent magnets or magnet devices, functions to ensure that there will be no flow of magnetic carrier particles in any power off condition.

Accordingly, the electrostatographic image reproduction machine 8 includes (a) a moveable imaging member 10 including an imaging surface 12; (b) imaging means 20, 30 for forming a latent image on the imaging surface; and (c) a toner development station CC that includes (i) developer housings 15A, 15B, 15C, 15D each containing in-use two-component developer material of toner particles and magnetic carrier particles for developing the latent images; (ii) a carrier replenishment system 200 including a carrier-only hopper 210 containing magnetic carrier particles and an air blower 240 for adding fresh magnetic carrier particles to the developer housings; and (iii) a teeter-totter valve or valve assembly 400 for metering the fresh magnetic carrier particles from the carrier-only hopper into the replenishment system.

Figure 3:
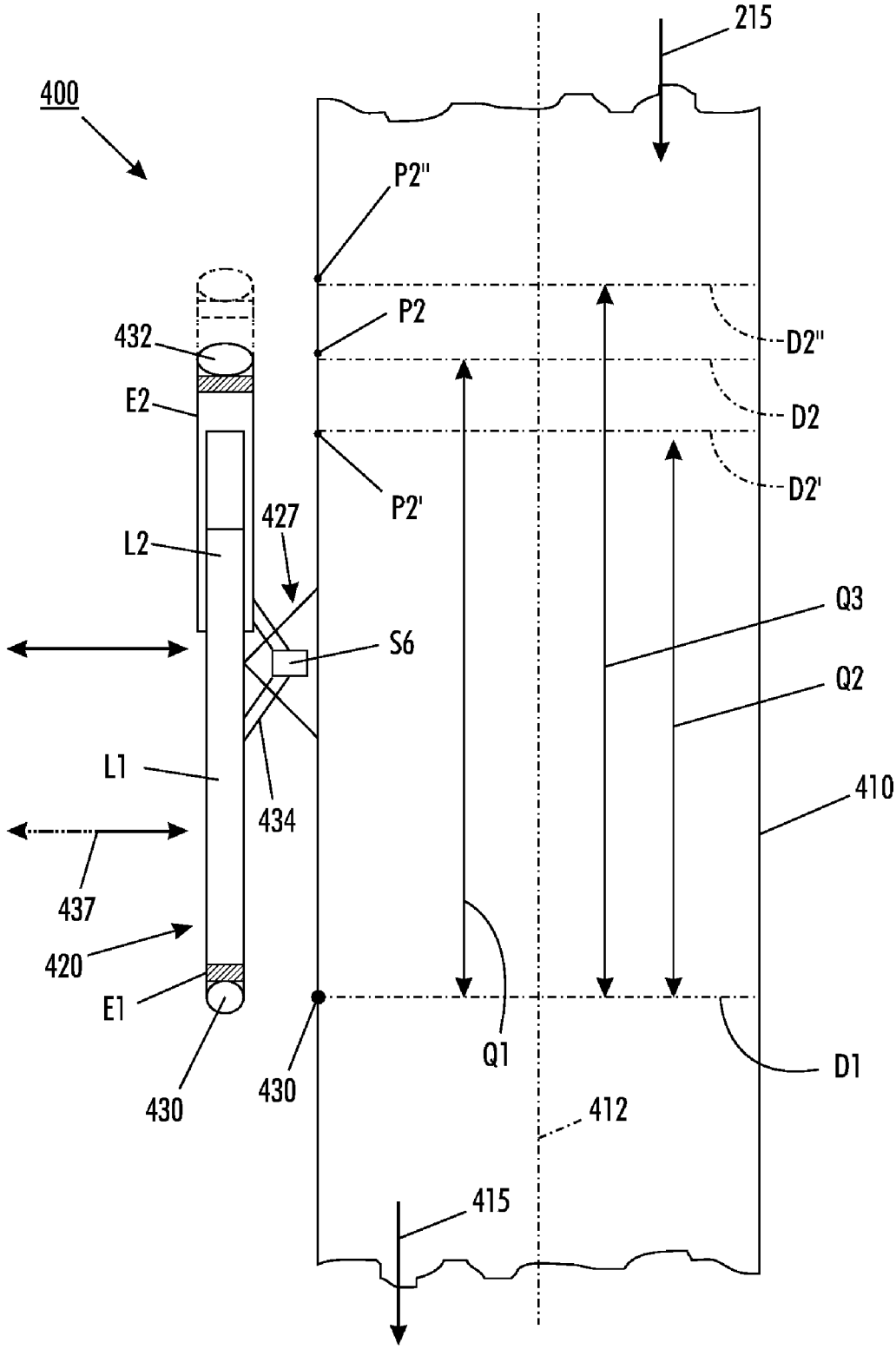
FIG. 3 is an enlarged detail illustration of a first embodiment of the teeter-totter valve in accordance with the present disclosure.
Figure 4:
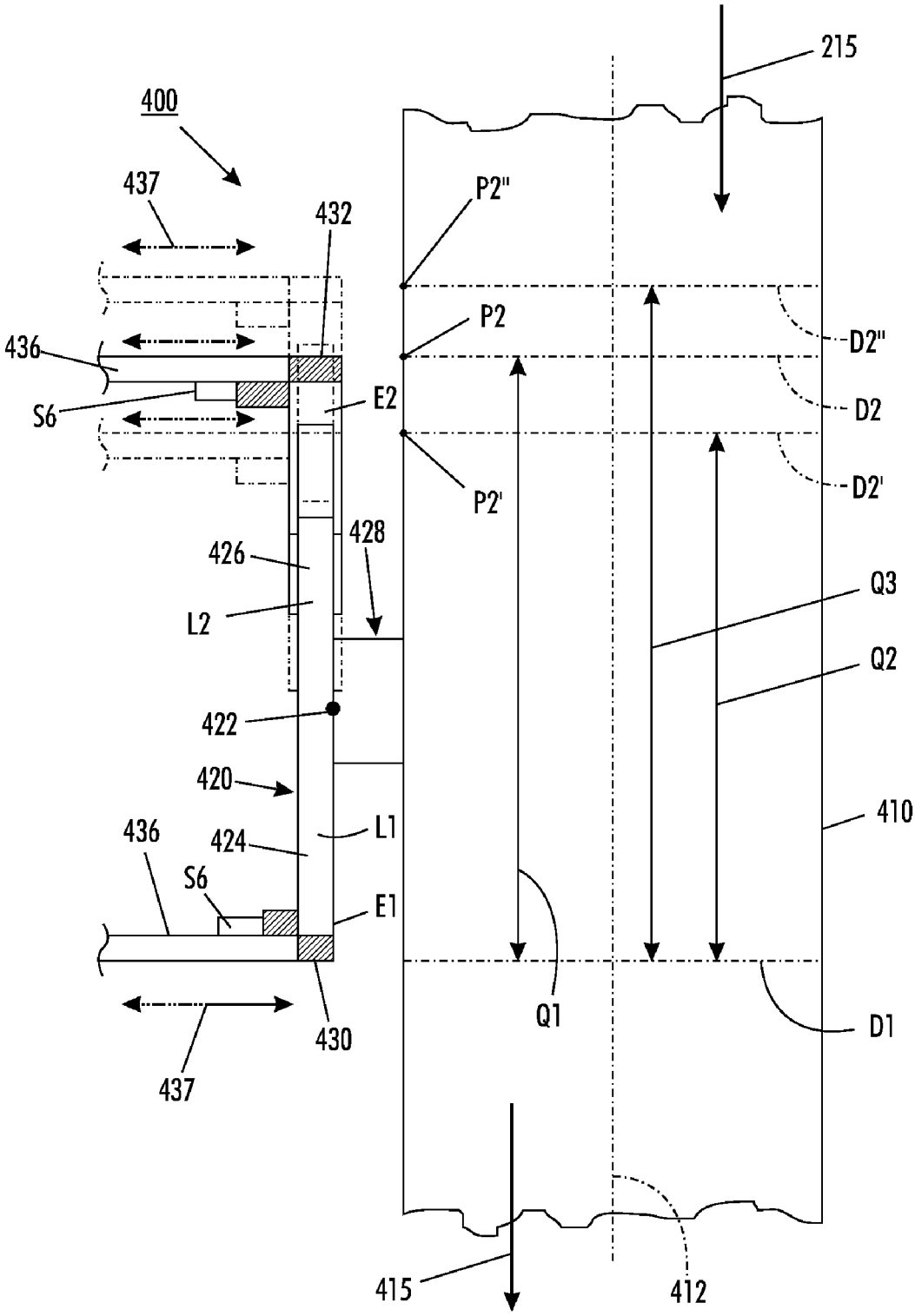
FIG. 4 is an enlarged detail illustration of a second embodiment thereof.

More specifically as illustrated in FIGS. 2-4, the system 200 includes 4 of the teeter-totter valve or valve assembly 400 (shown specifically as 400A, 400B, 400C, 400D—one valve for each transport line to a developer housing). The valves 400 (400A, 400B, 400C, 400D) are identical and so will be described simply as valve 400. Thus the teeter-totter valve assembly 400 includes (a) a hollow tube 410 (non-magnetic) having a longitudinal axis 412 and being connected to a discharge end of the carrier-only hopper 210 for flow 215 (FIGS. 3 and 4) of magnetic carrier particles out of the carrier-only hopper; (b) an elongate teeter-totter member 420 (non-magnetic) having a support point 422, a first arm portion 424, to one side of the support point, having a first distal end E1, and a second arm portion 426, to another side of the support point, having a second distal end E2; (c) a support assembly 427, 428 for supporting the elongate teeter-totter member 420 on and spaced from the non-magnetic hollow tube 410 with the first arm portion and the second arm portion being aligned with the longitudinal axis of the hollow tube as shown; (d) a first magnet device 430 (such as a permanent magnet) located at the first distal end E1 of the first arm portion; (e) a second magnet device 432 located at the second distal end E2 of the second arm portion; (f) moving means 434, 436 (i) for moving 437 each of the first magnet device 430 and the second magnet device 432 towards a first near point P1 and a second near point P2, P2', P2" on the hollow tube in order to create a point magnetic field and magnetic dam D1 within the hollow tube at the first near point and D2, D2', D2" at the second near point, thereby stopping flow of magnetic particles past the first near point and the second near point, and (ii) for moving 437 each of the first magnet device 430 and the second magnet device 432 away from a first near point and the second near point on the hollow tube to remove the point magnetic field and the magnetic dam from within the hollow tube at the first near point and at the second near point, thereby again allowing flow 415 (FIGS. 3 and 4) of magnetic particles past the first near point P1.

The controller 29 is provided with a program 29P, pf (FIG. 2) and connected to the moving means 434, 436, 437 for selectively coordinating a timing and movement of the first magnet device 430 and the second magnet device 432 towards and away from the first near point P1 and the second near point P2 on the hollow tube 410.

As shown, each tube 410 and its longitudinal axis 412 are located vertically in order to allow gravitational flow of magnetic particles from the hopper. From the support point, the first arm portion has a first, fixed length L1 to the first distal end, and the arm portion has a second, adjustable length L2 to the second distal end.

In one embodiment, as shown in FIG. 3, the teeter-totter member 420 is supported pivotally at the support point 422, and hence the moving means 434, 436, which includes a solenoid S6, comprise a pivot support and a pivot assembly 434 for alternatingly moving the first distal end E1 and the second distal end E2 about the support point towards and away from the first near point P1 and the second near point P2, P2', P2". The first magnet device 430 and the second magnet device 432 can be mounted directly at the first and the second distal ends E1, E2 respectively. Control for the pivoting assembly 434 includes the pivoting frequency program pf (FIG. 2) that can be varied controllably.

In another embodiment, as shown in FIG. 4, the moving means comprises a translating assembly 436 for translatingly moving the first magnet device 430 and the second magnet device 432 about the support point 422 towards and away from the first near point P1 and the second near point P2, P2', P2". The translating assembly 436 may for example include a non-pivot support 434 (FIG. 3) for the teeter-totter member 420, and a first translating member R1 mounted at the first distal end E1 of the first arm portion 424 and carrying the first magnet device 430 as shown. In addition, a second translating member R2 is also mounted at the second distal end E2 of the second, adjustable arm portion 426 and carrying the second magnet device 432 as shown.

As further shown more fully in FIG. 4, in each embodiment, the first length L1 of first arm portion 424 is fixed, but the second length L2 of the second arm portion 426 is adjustable. Accordingly, the second, adjustable length L2 of the second arm portion can be adjusted to be equal to the first, fixed length L1 of the first arm portion with a second near point P2 as shown. When operated as described above, with a top, second magnetic field and dam at D2 formed at the second near point P2, a quantity Q1 of carrier particles will flow past the first near point P1 into the replenishment system.

Depending on replenishment system requirements, the second, adjustable length L2 of the second arm portion can similarly also be adjusted to be shorter than the first, fixed length L1 of the first arm portion with a second near point P2' as shown. When then operated as described above, with a top, second magnetic field and dam at D2' formed at the second near point P2', a relatively smaller quantity Q2 of carrier particles will flow past the first near point P1 into the replenishment system.

As further illustrated, depending again on replenishment system requirements, the second, adjustable length L2 of the second arm portion can similarly also be adjusted to be longer than the first, fixed length L1 of the first arm portion with a second near point P2", as shown. When operated as described above, with a top, second magnetic field and dam at D2" formed at the second near point P2", a relatively larger quantity Q3 of carrier particles will flow past the first near point P1 into the replenishment system.

Accordingly, in the first embodiment as shown in FIG. 3 for example two permanent magnets 430, 432 are mounted as shown at each distal end E1, E2 on a "teeter-totter" member 420 and are movable for example pivotally, so that when one of the magnets 430, 432 is against the plastic tube 410, the other is away from the tube. A moving means 434, 436 including a solenoid S6, under control of the machine controller 29, 29P, pf, can be used to move 437 (translate FIG. 4, or swing/pivot FIG. 3) the magnets as such at variable frequencies pf. With the second or upper magnet 432 as shown moved away from a second near point P2, P2', P2" on the tube 410 and hence leaving no top magnetic field or magnetic dam D2, D2', D2" at the top or second near point P2, P2', P2", (which means the first or lower magnet 430 is moved against the tube at the first near point P1 on the tube thus creating a lower magnetic field and dam D1 thereat), magnetic material (magnetic carrier particles) will flow from the hopper past the second near point P2, P2', P2" and fill the plastic tube 410 all the way down to the lower magnetic field and dam D1 at the first near point P1.

In order to release or meter a desired quantity Q1, Q2, Q3 of the magnetic carrier particles in the tube as such, the solenoid S6 (and moving means 434, 436) is actuated to move (for example swing) the lower, first magnet 430 away from the first near point P1 while at the same time also similarly moving the top, second magnet 432 against the tube 410 at the second near point P2, P2', P2". Doing so creates a top magnetic field and dam D2, D2', D2" at the second near point P2, P2', P2", thereby stopping any flow of magnetic carrier from the hopper past the top magnetic field and dam D2, D2', D2", and at the same time thereby allowing all magnetic carrier particles between (i) the upper, second near point P2, P2', P2" (now dammed) and (ii) the lower, first near point P1 (now opened with no lower magnetic field and dam D1) to flow past the lower, first near point P1 as a metered quantity Q1, Q2, Q3 of such carrier particles.

Although the metered quantity Q1, Q2, Q3 of such carrier particles as described can be varied by adjusting the length of the second arm portion L2, it should be understood that such quantity Q1, Q2, Q3 of such carrier particles can also be effectively varied by means of the frequency program pf.

As can be seen, there has been provided a teeter-totter valve device for metering magnetic particles from a hopper that includes (i) a tube connected to the hopper for flow of magnetic particles out of the hopper; (ii) a teeter-totter member having a first arm including a first distal end, and a second adjustable arm including a second distal end; (iii) a support assembly supporting the teeter-totter member on and spaced from the tube; (iv) a first magnet located at the first distal end; (v) a second magnet located at the second distal; and (vi) a moving assembly for moving each of the first magnet and the second magnet towards and away from a first near point and a second near point on the tube to create or remove a point magnetic field and magnetic particles dam within the tube, thereby stopping or allowing flow of a desired quantity of magnetic particles past the first near point and past the second near point.

It will be appreciated that various of the above-disclosed and other features and functions of this embodiment, or alternatives thereof, may be desirably combined into other different systems or applications. Also that various presently unforeseen or unanticipated alternatives, modifications, variations or improvements therein may be subsequently made by those skilled in the art which are also intended to be encompassed by the following claims.

What is claimed is:

1. A teeter-totter valve device for metering magnetic particles from a hopper, the teeter-totter valve device comprising:

(a) a hollow tube connected to a discharge end of the hopper for flow of magnetic particles out of the hopper, said tube having a longitudinal axis;

(b) an elongate teeter-totter member having a support point, a first arm portion, to one side of said support point, having a first distal end, and a second arm portion, to another side of said support point, having a second distal end;

(c) a support assembly for supporting said elongate teeter-totter member on and spaced from said hollow tube with said first arm portion and said second arm portion being aligned with said longitudinal axis of said hollow tube;

(d) a first magnet device located at said first distal end of said first arm portion;

(e) a second magnet device located at said second distal end of said second arm portion;

(f) moving means (i) for moving each of said first magnet device and said second magnet device towards a first near point and a second near point on said hollow tube to create a point magnetic field and magnetic particles dam within said hollow tube at said first near point and at said second near point, thereby stopping flow of magnetic particles past said first near point and said second near point, and (ii) for moving each of said first magnet device and said second magnet device away from a first near point and said second near point on said hollow tube to remove said point magnetic field and said magnetic particles dam from within said hollow tube at said first near point and at said second near point, thereby again allowing flow of a desired quantity of magnetic particles past said first near point and past said second near point; and (g) a controller connected to said moving means for selectively coordinating timing and movements of said first magnet device and said second magnet device towards and away from said first near point and said second near point on said hollow tube.

2. The teeter-totter valve device of claim 1, wherein the longitudinal axis of said hollow tube is located vertically for gravitational flow of magnetic particles from said hopper.

3. The teeter-totter valve device of claim 1, wherein from said support point, said first arm portion has a first, fixed length to said first distal end, and said arm portion has a second, adjustable length to said second distal end.

4. The teeter-totter valve device of claim 3, wherein said second, adjustable length of said second arm portion is adjusted to be equal to said first, fixed length of said first arm portion.

5. The teeter-totter valve device of claim 3, wherein said second, adjustable length of said second arm portion is adjusted to be shorter than said first, fixed length of said first arm portion.

6. The teeter-totter valve device of claim 3, wherein said second, adjustable length of said second arm portion is adjusted to be longer than said first, fixed length of said first arm portion.

7. The teeter-totter valve device of claim 1, wherein said teeter-totter member is supported pivotally at said support point.

8. The teeter-totter valve device of claim 1, wherein said moving means comprise a pivot assembly for alternatingly moving said first distal end and said second distal end about said support point towards and away from said first near point and said second near point.

9. The teeter-totter valve device of claim 8, wherein said pivoting assembly has a pivoting frequency of said pivoting assembly that can be varied controllably.

10. The teeter-totter valve device of claim 1, wherein said moving means comprise a translating assembly for translatingly moving said first magnet and said second magnet about said support point towards and away from said first near point and said second near point.

11. A development station in an electrostatographic image reproduction machine comprising;

(a) developer housings each containing in-use two-component developer material including toner particles and magnetic carrier particles for developing images;

(b) a carrier-only hopper containing magnetic carrier particles for adding to said developer housings; and (c) a teeter-totter valve device for metering magnetic carrier particles from said carrier-only hopper, the teeter-totter valve device including:

(i) a hollow tube connected to a discharge end of said carrier-only hopper for flow of magnetic carrier particles out of said carrier-only hopper, said tube having a longitudinal axis;

(ii) an elongate teeter-totter member having a support point, a first arm portion, to one side of said support point, having a first distal end, and a second arm portion, to another side of said support point, having a second distal end;

(iii) a support assembly for supporting said elongate teeter-totter member on and spaced from said hollow tube with said first arm portion and said second arm portion being aligned with said longitudinal axis of said hollow tube;

(iv) a first magnet device located at said first distal end of said first arm portion;

(v) a second magnet device located at said second distal end of said second arm portion; and (vi) moving means (i) for moving each of said first magnet device and said second magnet device towards a first near point and a second near point on said hollow tube to create a point magnetic field and magnetic particles dam within said hollow tube at said first near point and at said second near point, thereby stopping flow of magnetic carrier particles past said first near point and said second near point, and (ii) for moving each of said first magnet device and said second magnet device away from a first near point and said second near point on said hollow tube to remove said point magnetic field and said magnetic particles dam from within said hollow tube at said first near point and at said second near point, thereby again allowing flow of a desired quantity of magnetic carrier particles past said first near point and past said second near point.

12. The development station of claim 11, wherein from said support point, said first arm portion has a first, fixed length to said first distal end, and said arm portion has a second, adjustable length to said second distal end.

13. The development station of claim 11, wherein said teeter-totter member is supported pivotally at said support point.

14. The development station of claim 11, wherein said moving means comprise a pivot assembly for alternatingly moving said first distal end and said second distal end about said support point towards and away from said first near point and said second near point.

15. The development station of claim 11, wherein said moving means comprise a translating assembly for translatingly moving said first magnet and said second magnet about said support point towards and away from said first near point and said second near point.

16. An electrostatographic image reproduction machine comprising:

(a) a moveable imaging member including an imaging surface;

(b) imaging means for forming a latent image on said imaging surface;

(c) a toner development station including developer housings and a carrier-only hopper containing magnetic carrier particles for adding to said developer housings; and (d) a teeter-totter valve device for metering magnetic carrier particles from said carrier-only hopper, the teeter-totter valve device including:

(i) a hollow tube connected to a discharge end of said carrier-only hopper for flow of magnetic carrier particles out of said carrier-only hopper, said tube having a longitudinal axis;

(ii) an elongate teeter-totter member having a support point, a first arm portion, to one side of said support point, having a first distal end, and a second arm portion, to another side of said support point, having a second distal end;

(iii) a support assembly for supporting said elongate teeter-totter member on and spaced from said hollow tube with said first arm portion and said second arm portion being aligned with said longitudinal axis of said hollow tube;

(iv) a first magnet device located at said first distal end of said first arm portion;

(v) a second magnet device located at said second distal end of said second arm portion; and (vi) moving means (i) for moving each of said first magnet device and said second magnet device towards a first near point and a second near point on said hollow tube to create a point magnetic field and magnetic particles dam within said hollow tube at said first near point and at said second near point, thereby stopping flow of magnetic carrier particles past said first near point and said second near point, and (ii) for moving each of said first magnet device and said second magnet device away from a first near point and said second near point on said hollow tube to remove said point magnetic field and said magnetic particles dam from within said hollow tube at said first near point and at said second near point, thereby again allowing flow of a desired quantity of magnetic carrier particles past said first near point and past said second near point.

17. The electrostatographic reproduction machine of claim 16, wherein from said support point, said first arm portion has a first, fixed length to said first distal end, and said arm portion has a second, adjustable length to said second distal end.

18. The electrostatographic reproduction machine of claim 16, wherein said teeter-totter member is supported pivotally at said support point.

19. The electrostatographic reproduction machine of claim 16, wherein said moving means comprise a pivot assembly for alternatingly moving said first distal end and said second distal end about said support point towards and away from said first near point and said second near point.

20. The electrostatographic reproduction machine of claim 16, wherein said moving means comprise a translating assembly for translatingly moving said first magnet and said second magnet about said support point towards and away from said first near point and said second near point.

* * * * *